US005848328A

United States Patent [19]

Ueda et al.

[11] Patent Number: 5,848,328

[45] **Date of Patent: *Dec. 8, 1998**

[54] IMAGE FORMING APPARATUS HAVING REINFORCING MEMBER

[75] Inventors: Yoshihiro Ueda; Kunio Nakai, both of Osaka, Japan

[73] Assignee: Mita Industrial Co., Ltd., Osaka-fu, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 814,846

[22] Filed: Mar. 11, 1997

[30] Foreign Application Priority Data

Mar. 13, 1996 [JP] Japan ..... 8-055999

[51] Int. Cl.[6] ..... G03G 15/00

[52] U.S. Cl. ..... 399/107; 399/118; 248/900

[58] Field of Search ..... 399/107, 118, 399/124–126, 405, 108; 347/138, 152, 245, 257, 263; 248/548, 672, 900, 903, 563, 580; 312/317.1, 351.1

[56] References Cited

U.S. PATENT DOCUMENTS 4,641,947 2/1987 Ishida et al. ..... 399/125
4,862,218 8/1989 Tsunoda et al. ..... 399/118
5,072,239 12/1991 Mitchum et al. .
5,319,432 6/1994 Akashi et al. ..... 399/124
5,418,601 5/1995 Fujisawa et al. ..... 399/125
5,532,826 7/1996 Miyao et al. ..... 358/296

*Primary Examiner*—Robert Beatty
*Attorney, Agent, or Firm*—Jordan and Hamburg

[57] ABSTRACT

An electrophotographic type image forming apparatus is provided with a base frame for supporting an image forming unit and an optical unit frame located above the base frame for supporting an optical unit, the optical unit frame having an extension portion positioned above the discharge tray. The apparatus is further provided with a reinforcing member attached to the optical unit frame. The reinforcing member has an attachment portion extending in a horizontal direction for reinforcing the extension portion of the optical unit frame, and a restricting portion extending in a vertical direction and having a lower end operable to come into contact with a specified portion of the base frame when the optical unit frame is subjected to an excessive load. The optical unit frame is prevented from deformation because the lower end of the restricting portion comes into contact with the base frame when an excessive load is applied to the optical unit frame, which assures high quality image formation.

5 Claims, 8 Drawing Sheets

IMAGE FORMING APPARATUS HAVING REINFORCING MEMBER

BACKGROUND OF THE INVENTION

This invention relates to an electrophotographic type image forming apparatus of a compact size.

There have been known compact image forming apparatuses having a smaller length. Such an image forming apparatus has an upper section including an optical unit for guiding light reflected from an illuminated document to a photosensitive drum, and a lower section including a copy paper storage unit for storing copy paper, an image forming unit including the photosensitive drum for forming a toner image from reflected light, and a fixing unit for fixing a transferred toner image on copy paper. The upper section is openable with respect to the lower section. The paper storage unit, the image forming unit and the fixing unit are placed over one another. Copy paper is inverted a specified position of a paper transport path and then fed to the fixing unit to fix a toner image on the copy paper to thereby reduce the width of the image forming apparatus. In addition, a discharge tray for stacking discharged copy paper is arranged within the range of width of the upper section, thereby reducing the width of the image forming apparatus. For example, Japanese Unexamined Patent Publication No. 6-208299 shows such an image forming apparatus.

In the image forming apparatus of Japanese Unexamined Patent Publication No. 6-208299, a space is provided to take out copy paper from the discharge tray easily. However, this space makes it difficult to maintain a sufficient support in a part of the upper section above the discharge tray. Accordingly, the upper section is likely to be deformed by external forces, e.g., a compressing load of above-placed articles when being transported, an impact caused when being closed onto the lower section. Consequently, there is a likelihood that the optical unit distorts, causing a deviation in an optical axis and adverse effect to image forming.

SUMMARY OF THE INVENTION

It is an object of the present invention to provide an image forming apparatus which has overcome the problems residing in the prior art.

It is another object of the present invention to provide an image forming apparatus which can assuredly prevent an optical unit from deforming.

According to an aspect of the present invention, an image forming apparatus comprises an optical unit for guiding a light image from a document, an image forming unit for forming a toner image in accordance with the light image, a transfer unit for transferring the toner image on copy paper, a discharge tray for receiving copy paper transferred with the toner image, a base frame for supporting the image forming unit, and an optical unit frame located above the base frame for supporting the optical unit, the optical unit frame having an extension portion positioned above the discharge tray. Further, a reinforcing member is attached to the optical unit frame. The reinforcing member includes an attachment portion extending in a horizontal direction for reinforcing the extension portion of the optical unit frame, and a restricting portion extending in a vertical direction and having a lower end operable to come into contact with a specified portion of the base frame when the optical unit frame is subjected to an excessive load.

The lower end of the restricting portion comes into contact with the base frame when an excessive load is applied to the optical unit frame. This allows the excessive load to be transmitted to the base frame, consequently preventing deformation and distortion of the optical unit frame. Accordingly, the image forming apparatus can assuredly eliminate deterioration in the quality of image formation caused by deviation of the optic axis, and produce an image having a higher quality.

These and other objects, features and advantages of the present invention will become more apparent upon a reading of the following detailed description and accompanying drawings.

DETAILED DESCRIPTION OF THE PREFERRED EMBODIMENTS OF THE INVENTION

Figure 1:
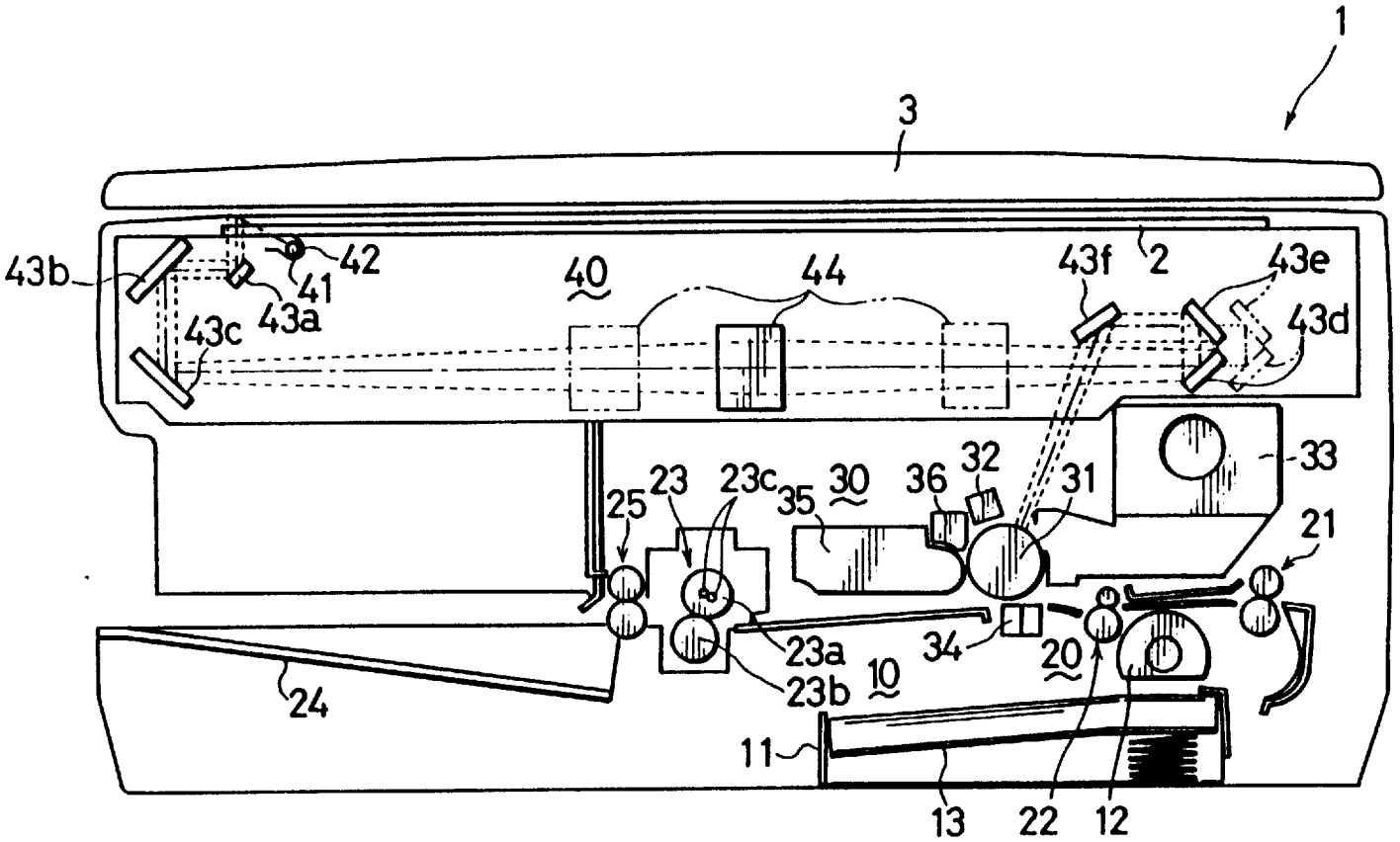
FIG. 1 is a front view showing an internal construction of an image forming apparatus according to the invention.

Referring to FIG. 1 showing an internal construction of an image forming apparatus embodying the invention, a main body 1 of the image forming apparatus is provided with a paper storage unit 10 located on a bottom of the main body; a paper transporting unit 20 located above the paper storage unit 10; an image forming unit 30 located above the paper transporting unit 20; and an optical unit 40 located in an upper portion of the main body. Further, the main body 1 is provided with a contact glass 2 located in a center of a top surface of the main body 1 and an document cover 3 for keeping an document in place on the contact glass 2.

The paper storage unit 10 includes a paper storage cassette 11 for storing copy paper and a paper feed roller 12 located on a right end of the paper storage cassette 11. The paper storage cassette 11 is provided with a paper holding member in which copy paper is placed. The paper holding member is upwardly urged. The paper feed roller 12 has a semicircular shape in section and its flat portion is directed downward in its stopped position so that insertion and withdrawal of the paper storage cassette 11 can be made without hindrance by the paper feed roller 12.

The optical unit 40 includes an exposing lamp 41, a reflector 42, reflecting mirrors 43*a*, 43*b*, 43*c*, 43*d*, 43*e* and 43*f*, and a lens 44. The exposing lamp 41, the reflector 42 and the reflecting mirror 43*a*, and the reflecting mirrors 43*b* and 43*c* are each able to reciprocate rightward and leftward as viewed in FIG. 1 at a constant rate of V or V/2. When these are moved rightward, an document image is scanned to form a latent image on a photosensitive drum 31 as described later. In addition, the lens 44 and the reflecting mirrors 43*d* and 43*e* are movable rightward and leftward as viewed in FIG. 1 in response to magnification.

The image forming unit 30 includes a rotatably supported photosensitive drum 31. Also, the image forming unit 30 further includes a main charger 32, a developing portion 33, a transfer/separation device 34, a cleaning portion 35 and an electrostatic charge eliminating portion 36, which are arranged around the photosensitive drum 31 from the upstream with respect to a rotation direction of the photosensitive drum 31. The main charger 32 charges a surface of the photosensitive drum 31 uniformly at a fixed potential. At a position directly downstream of the main charger 32, an area for exposure of a light image from the document is provided to form an electrostatic latent image on the surface of the photosensitive drum 31. The developing portion 33 allows toner to adhere to the electrostatic latent image for development. The details of the developing portion is described later. In the transfer/separation device 34, the toner image formed on the surface of the photosensitive drum 31 is transferred onto copy paper and the copy paper is separated from the photosensitive drum 31 after the toner image is transferred onto the copy paper. The cleaning portion 35 cleans toner remaining on the surface of the photosensitive drum 31 after the transference of the toner image. The electrostatic charge eliminating portion 36 eliminates remaining electric charge from the surface of the photosensitive drum 31.

The paper transporting unit 20 including a pair of transporting rollers 21 for transporting copy paper fed from the paper storage unit 10 to the photosensitive drum 31; a pair of registration rollers 22 which are driven in synchronism with the scanning of the optical unit 40; the fixing portion 23 for fixing the transferred toner image on the copy paper separated from the photosensitive drum 31 and also transporting the copy paper; and a pair of discharge rollers 25 for discharging the copy paper onto the discharge tray 24. A space is provided above the discharge tray 24 for taking out the copy paper placed on the discharge tray.

The fixing portion 23 includes a heating roller 23*a* and a pressure roller 23*b*. The heating roller 23*a* has a heater 23*c* disposed in the heating roller and is maintained at a suitable fixing temperature at which a transferred toner image is suitably fixed in place on copy paper. The pressure roller 23*b* is made of a material having more resilience than the surface of the heating roller 23*a* and is pressed against the heating roller 23*a* by a biasing external force.

Next, an operation of the image forming apparatus will be described below.

When a copy start key is pressed after a desired magnification and a desired number of copies are set, the copying operation is started. Specifically, light from the exposing lamp 41 is reflected on the document placed on the contact glass 2 and the reflected light is guided into the lens 44 through the reflecting mirrors 43*a* to 43*c* and in turn passes through the reflecting mirrors 43*d* to 43*f* to expose the surface of the photosensitive drum 31. At this time, the surface of the photosensitive drum 31 is charged uniformly by the main charger 32, and a specified area of the photosensitive drum 31 is exposed to light by the optical unit 40 to form an electrostatic latent image. Then, charged toner which is fed from the developing portion 33 to the photosensitive drum 31 is electrostatically attracted to the electrostatic latent image to develop into an toner image.

In the meantime, a top copy paper of a stack of copy paper on the paper holding member 13 is brought into contact with a cylindrical part of the paper feed roller 12 rotationally driven and is fed to the pair of registration rollers 22 via the pair of transporting rollers 21. The copy paper is then transported by the pair of registration rollers 22 in synchronism with the scanning movement of the optical unit 40 into a gap between the photosensitive drum 31 and the transfer/separation device 34.

Subsequently, the toner image on the photosensitive drum 31 is transferred onto the copy paper by the transfer/separation device 34. Thereafter, the copy paper is separated from the photosensitive drum 31 and transported to the fixing portion 23. In the fixing portion 23, while the copy paper is transported by the rotating heating roller 23*a* and pressure roller 23*b*, the toner image on the copy paper is fused on the copy paper with heat from the heating roller 23*a* and pressure from the pressure roller 23*b*. The copy paper is discharged onto the discharge tray 24 by the pair of discharge rollers 25 to be placed on the discharge tray 24.

Next, with reference to FIGS. 2 to 8, a supporting structure of the main body 1 of the image forming apparatus will be described below.

Figure 2:
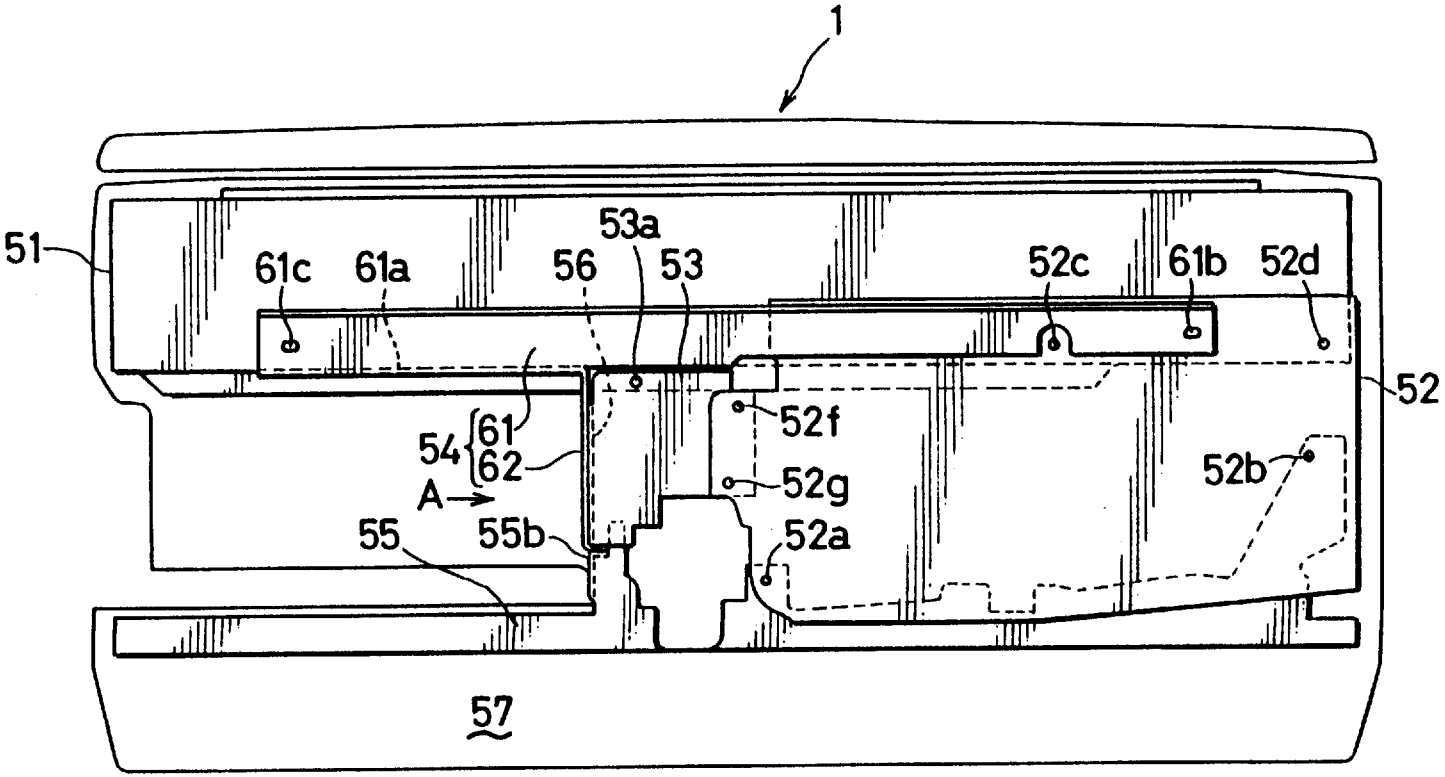
FIG. 2 is a front view showing a supporting structure of the image forming apparatus.
Figure 3:
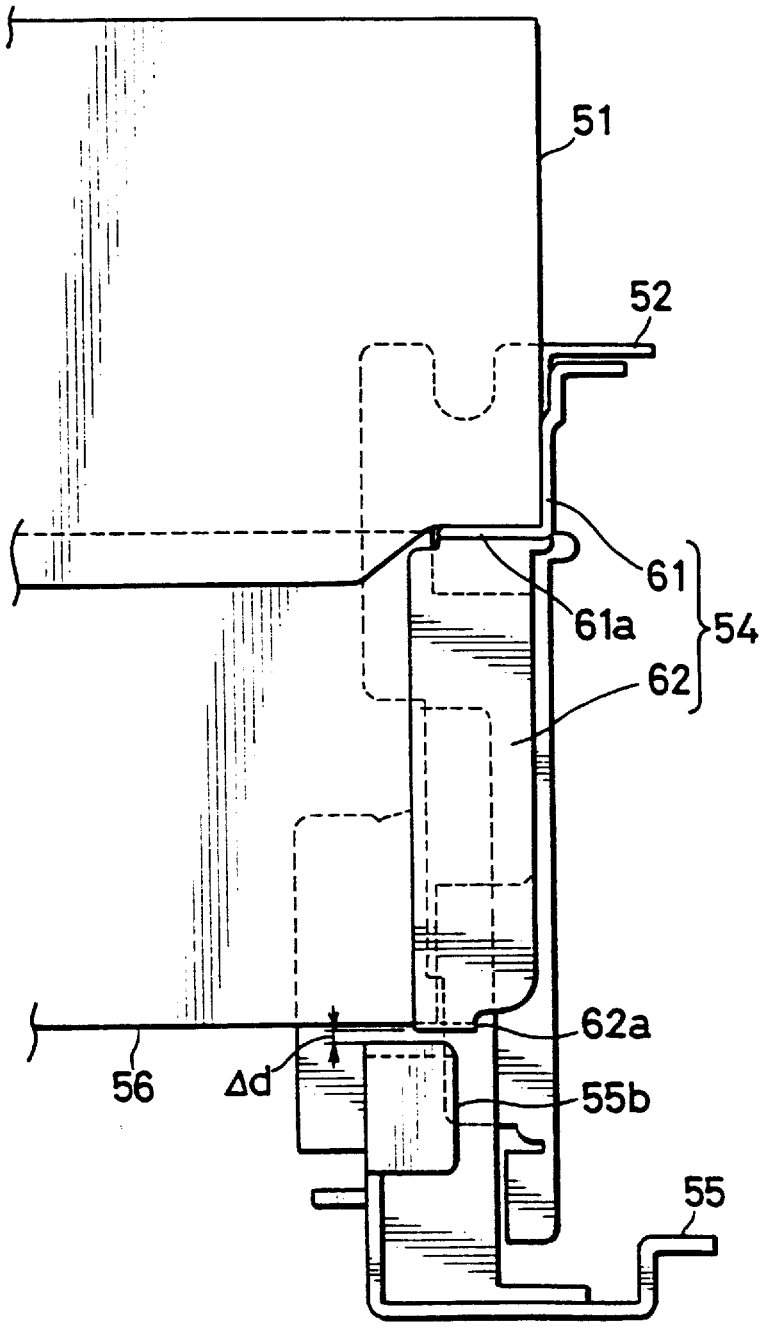
FIG. 3 is a side view showing a front portion of the supporting structure as viewed from the direction of an arrow A in FIG. 2.
Figure 4:
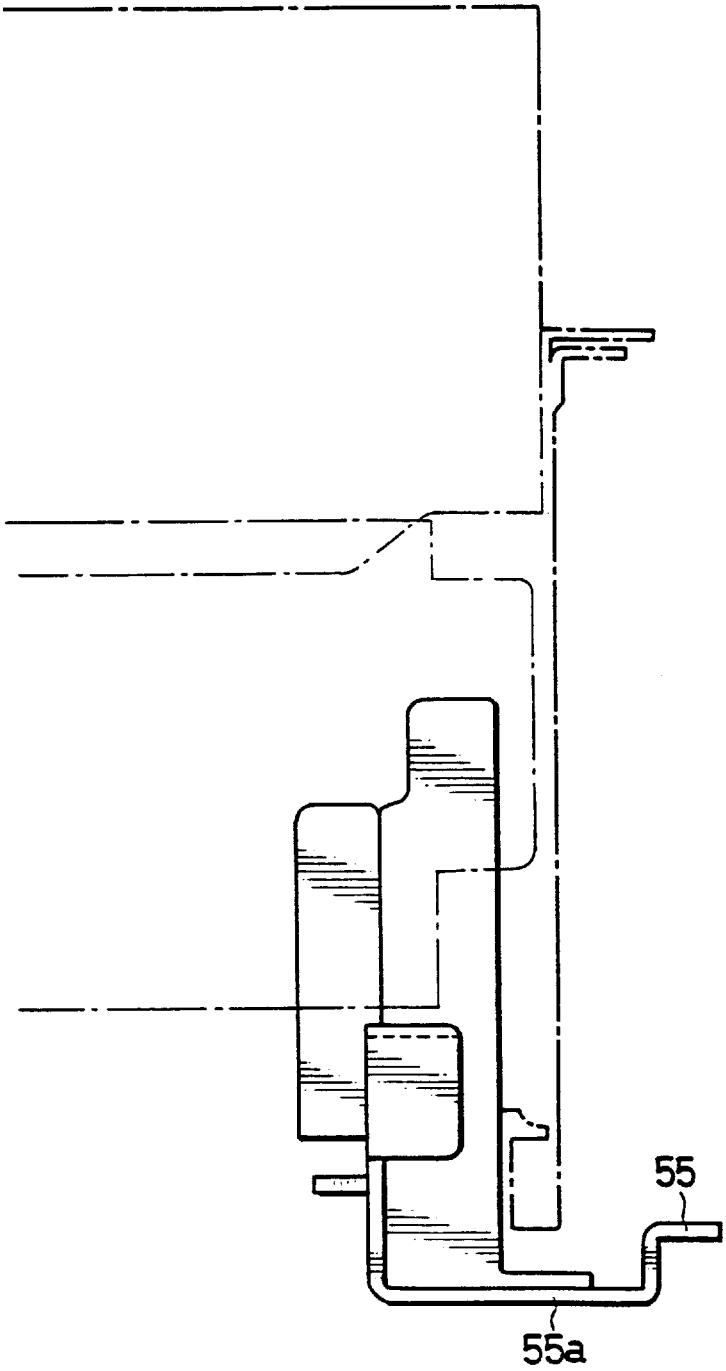
FIG. 4 is a side view showing a lower front support member of the supporting structure.
Figure 5:
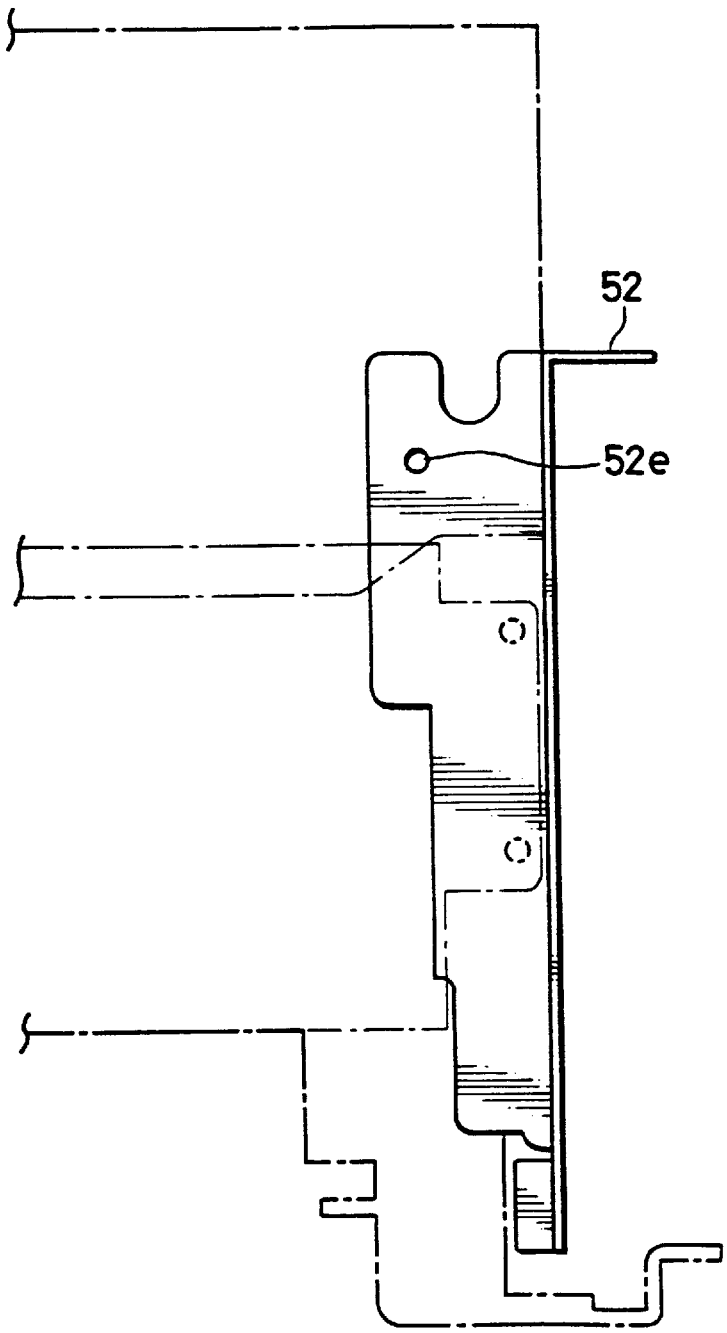
FIG. 5 is a side view showing an upper front support member of the supporting structure.
Figure 6:
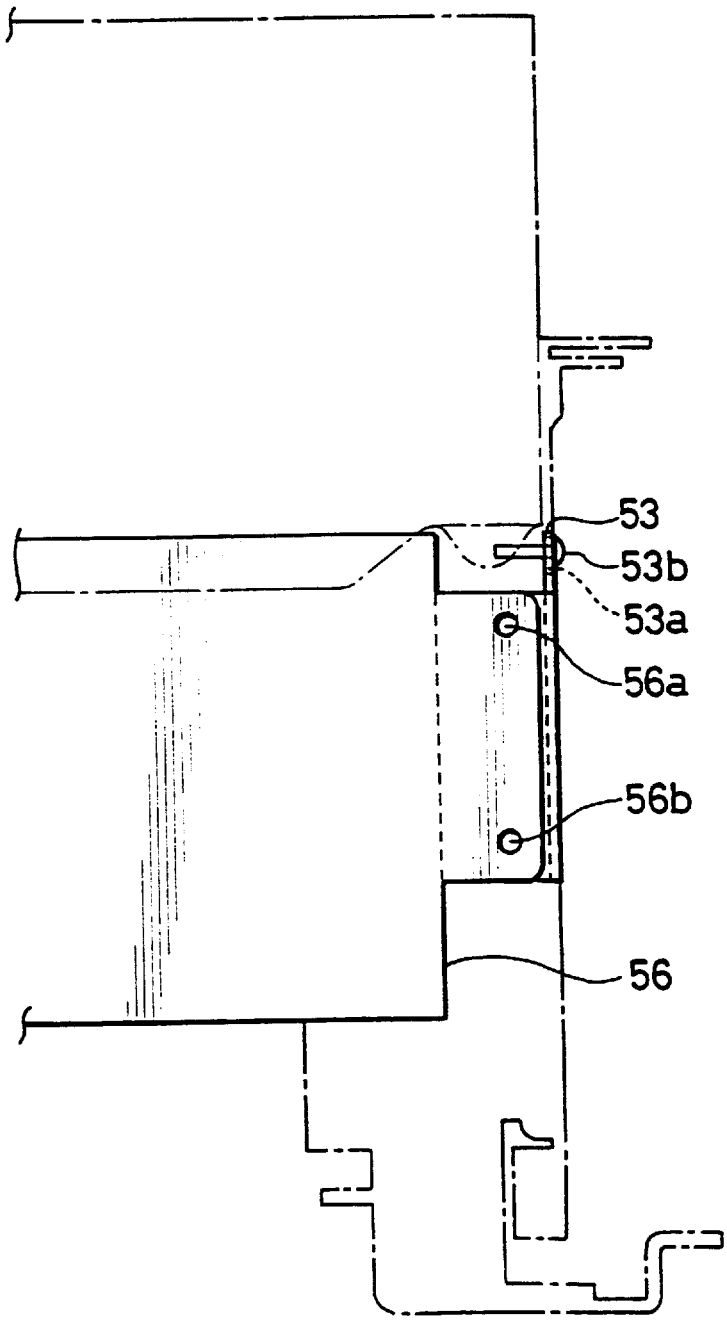
FIG. 6 is a side view showing an intermediate front support member of the supporting structure.
Figure 7:
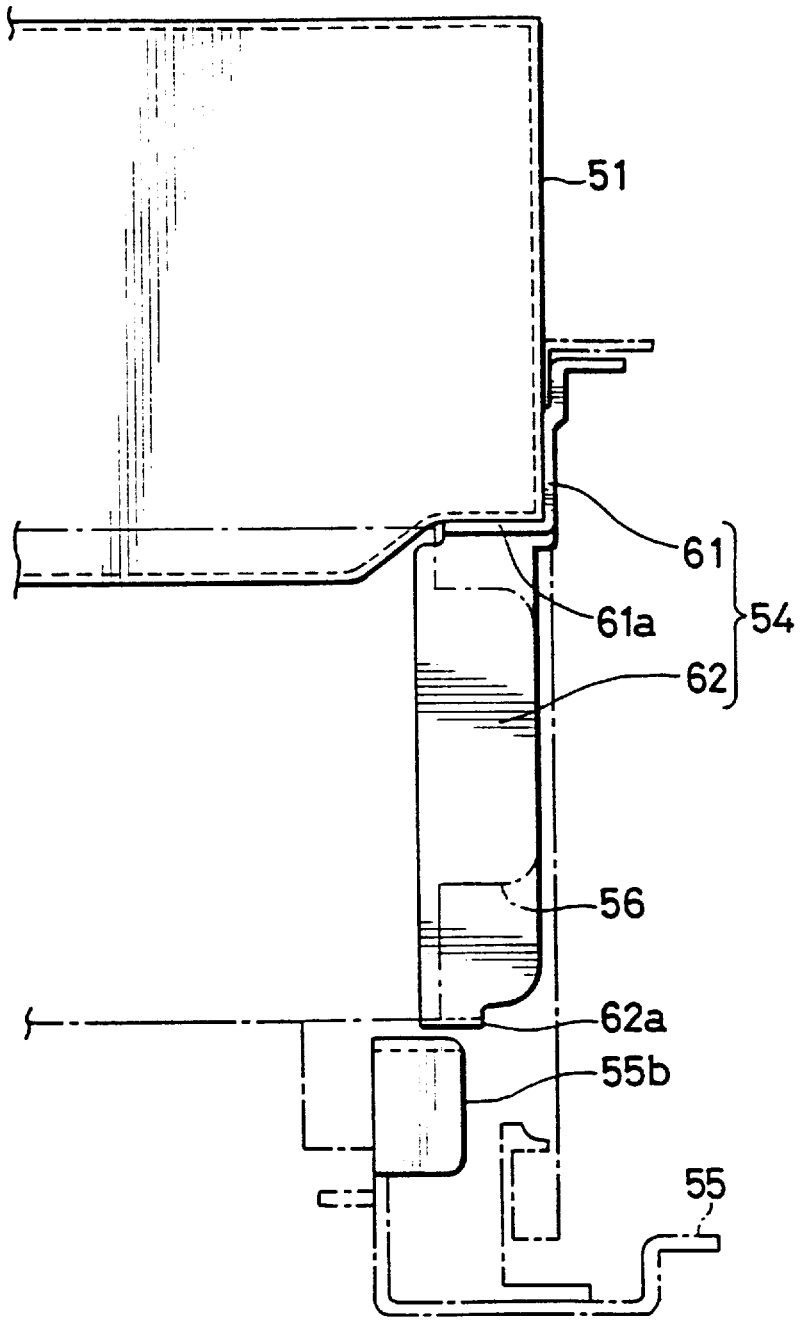
FIG. 7 is a side view showing a combination of an optical unit frame and a frame reinforcing member.
Figure 8:
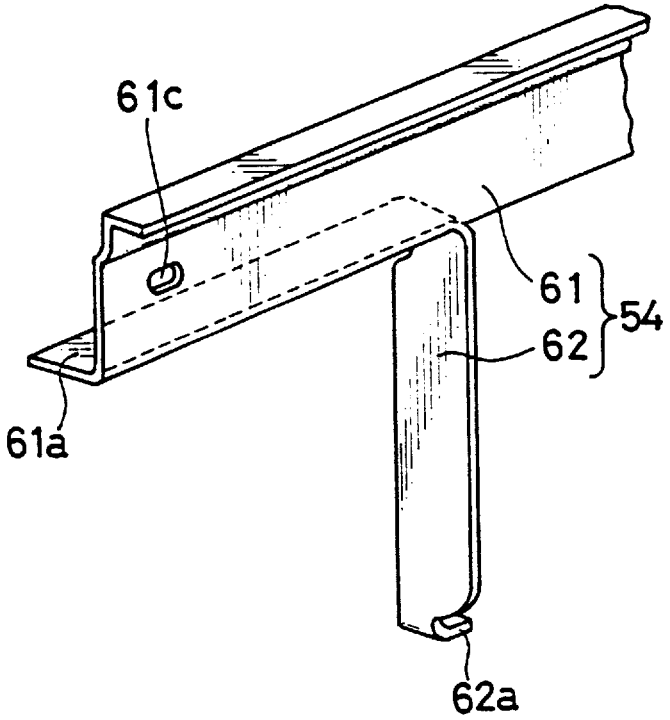
FIG. 8 is a perspective view showing a part of the frame reinforcing member.

FIG. 2 is a front view showing a supporting structure including a optical unit frame 51 and other supporting members; FIG. 3 is a view showing a front portion of the supporting structure as viewed from the direction of an arrow A in FIG. 2; FIGS. 4 to 7 illustrate each part of the front portion shown in FIG. 3; FIG. 4 shows a lower front support member 55; FIG. 5 shows an upper front support member 52; FIG. 6 shows an intermediate front support member 53 and a stay 56; FIG. 7 shows a combination of the optical unit frame 51 and a frame reinforcing member 54; and FIG. 8 is a perspective view showing a part of the frame reinforcing member 54.

As shown in FIG. 2, the main body 1 of the image forming apparatus is provided with the optical unit frame 51 having the form of a generally rectangle for supporting the optical unit 40; the upper front support member 52 and the intermediate front support member 53 for supporting a front portion of the optical unit frame 51; the frame reinforcing member 54; the lower front support member 55 for supporting the frame reinforcing member 54 when load is applied to the optical unit frame 51; a rear support member (not shown) for supporting a rear portion of the optical unit frame 51; and a upright stay 56 extending in a widthwise direction for connecting the intermediate front support member 53 and the rear member and supporting the optical unit frame 51.

The lower front support member 55 has a bottom portion 55*a*, as shown in FIG. 4. As shown in FIG. 2, the bottom portion 55*a* is fixedly attached to the bottom 57 of the main body 1 with screws or the like.

The upper front support member 52 has lower holes 52*a*, 52*b*, upper holes 52*c*, 52*d*, and right and left side holes 52*e*, 52*f*, 52*g*, as shown in FIG. 2. The upper front support member 52 is fixedly attached to the lower front support member 55 at the lower holes 52*a*, 52*b*, and to the front portion of the optical unit frame 51 at the holes 52*c*, 52*d*, as shown in FIG. 2, and to a side portion of the optical unit frame 51 at the hole 52*e*, as shown in FIG. 5, with screws, thereby supporting the optical unit frame 51. The upper front support member 52 is also fixedly attached to the intermediate front support member 53 at the holes 52*f*, 52*g* with screws.

The intermediate front support member 53 has a bent portion bent on a left end thereof. The bent portion of the intermediate front support member 53 is fixedly attached to the stay 56 with screws at holes 56*a*, 56*b* and also fixedly attached to the optical unit frame 51 with a screw 53*b* in a vertically elongated hole 53*a,* as shown in FIG. 6, thereby supporting the optical unit frame 51.

The fixing level of the screw 53*b* with respect to the elongated hole 53*a* is adjusted so that a vertical plane passing the optical axis of the optical unit 40 perpendicularly intersecting a vertical plane passing an axis of the photosensitive drum 31 as shown in FIG. 1.

The frame reinforcing member 54 is made of a metallic material having a suitable thickness to assure a necessary strength. The frame reinforcing member 54 includes an attachment portion 61 horizontally extending along the front portion of the optical unit frame 51, i.e., from a part of the optical unit frame 51 above the discharge tray 24 to a part of the optical unit frame 51 above the upper front support member 52, and a restricting portion 62 extending downward from a center or a slightly left side from the center of the attachment portion 61.

As shown in FIG. 8, the attachment portion 61 has on a left half a supporting portion 61*a* extending inward. The restricting portion 62 is formed by bending a supporting portion of a right half downward. A lower end of the restricting portion 62 is bent rightward to form a contact portion 62*a,* as shown in FIG. 8.

The attachment portion 61 has holes 61*b,* 61*c* at right and left ends and is attached to a right front portion of the optical unit frame 51 and the upper front support member 52 at the hole 61*b,* and to a left front portion of the optical unit frame 51 at the hole 61*c* with screws, as shown in FIG. 2.

The restricting portion 62 extending vertically from the attachment portion 61 faces a left side of the stay 56 as shown in FIG. 2 and the contact portion 62*a* freely comes into a gap between a seating portion 55*b* of the lower front support member 55 and the stay 56, as shown in FIG. 3.

In the case that the seating portion 55*b* is positioned leftward away from the stay 56, the restricting portion 62 is formed so that the contact portion 62*a* is above the seating portion 55*b*.

Between a lower surface of the contact portion 62*a* and an upper surface of the seating portion 55*b* is provided a clearance Δ d as shown in FIG. 3 to allow the above-mentioned perpendicular adjustment of the screw 53*b*. For example, there is provided a clearance Δ d of about 2 mm. In the presence state of the clearance Δ d, the optical unit frame 51 is supported by the upper front support member 52 attached to the lower front support member 55 and the intermediate front support member 53 attached to the upper front support member 52. The intermediate front support member 53 is connected with the optical unit frame 51 by the screw 53*b* passed through the elongated hole 53*a*.

When a load is applied to the part of the optical unit frame 51 above the discharge tray 24, the load is transmitted to the supporting portion 61*a* of the frame reinforcing member 54. However, a downward deformation of the supporting portion 61*a* is hindered by the rigidity of the attachment portion 61 extending to the right end of the optical unit frame 51. Even when the supporting portion 61*a* of the frame reinforcing member 54 is subjected to an excessive load and a downward deformation occurs, the contact portion 62*a* comes to contact with the seating portion 55*b* of the lower front support member 55, so that the optical unit frame 51 is supported by the lower front support member 55 by the way of the restricting portion 62 of the frame reinforcing member 54. Thus, little deformation occurs in the optical unit frame 51.

As mentioned above, in the image forming apparatus, an excessive load applied to the part of the optical unit frame 51 above the discharge tray 24 is received by the lower front support member 55 through the left half of the attachment portion 61 and the contact portion 62*a* of the frame reinforcing member 54, consequently preventing the optical unit frame 51 from deforming. Accordingly, the optical unit 40 is assuredly maintained in the specified position and posture.

In other words, unless there is provided the frame reinforcing member 54, a load such as compressing force or impact applied to the optical unit frame during transportation of the apparatus concentrates at the screw 53*b,* consequently changing the vertical position of the screw 53*b* in the elongated hole 53*a,* finally damaging the perpendicular relationship between the axis of the optical unit and the axis of the photosensitive drum. In contrast to this, provision of the frame reinforcing member 54 can assuredly avoid such a deviation, and thus prevent deterioration in the quality of image formation and produce images having a high quality.

Furthermore, since the attachment portion 61 of the frame reinforcing member 54 extends from the left end to the right end of the optical unit frame 51 as shown in FIG. 2, the part of the optical unit frame 51 above the discharge tray 24 can be reinforced by the rigidity of the attachment portion 61 to prevent distortion of the optical unit frame 51 by compressing load or other external forces.

In addition, the contact portion 62*a* provided at the lower end of the restricting portion 62 and having the form of a plate can reduce the concentration of load on the seating portion 55*b* of the lower front support member 55.

The present invention can be applied to an image forming apparatus having a so-called clamshell type body which is provided with an upper section including an optical unit and a lower section including an image forming unit and a support pin at a bottom right corner and extending rearward so that the upper section is opened at the support pin. In this case, the frame reinforcing member can prevent the optical unit frame from receiving impact caused when the upper section is closed.

Further, the foregoing embodiment in which the restricting portion 62 of the frame reinforcing member 54 is formed by bending the horizontal 61*a* of the reinforcing member 61 downward at the midpoint thereof. However, according to the present invention, the restricting portion 62 and the attachment portion 61 are made separately. Thereafter, they are integrally connected with each other into the frame reinforcing member 54.

Although the present invention has been fully described by way of example with reference to the accompanying drawings, it is to be understood that various changes and modifications will be apparent to those skilled in the art. Therefore, unless otherwise such changes and modifications depart from the scope of the present invention, they should be construed as being included therein.

What is claimed is:

1. A structure for use in an image forming apparatus having an operating mode during which said images are formed comprising:

a base frame;

a unit frame disposed on said base frame;

a reinforcing member attached to the unit frame and having a downward facing portion;

said base frame having a base frame portion underlying said downward facing portion;

said downward facing portion being spaced from said base frame portion when said image forming apparatus is in said operating mode and in the absence of application of an excessive load to the unit frame;

said downward facing portion being in contact with said base frame portion upon application of an excessive load to said unit frame.

2. A structure for use in an image forming apparatus according to claim 1 wherein a gap is provided between said downward facing portion and said base frame portion when said image forming apparatus is in said operating mode and in the absence of application of an excessive load to the unit frame, and means on said base frame and said unit frame for adjusting said gap.

3. An electrophotographic type image forming apparatus comprising:

a base frame supporting an image forming unit;

an optical unit frame located above the base frame supporting an optical unit;

a reinforcing member attached to the optical unit frame and having a restricting portion;

said base frame having a base frame portion;

said restricting portion being spaced from said base frame portion in the absence of application of an excessive load to the unit frame;

said restricting portion being in contact with said base frame portion upon application of an excessive load to said optical unit frame.

4. An image forming apparatus comprising:

an optical unit for guiding a light image from a document;

an image forming unit for forming a toner image in accordance with the light image;

a transfer unit for transferring the toner image on copy paper;

a discharge tray for receiving copy paper transferred with the toner image;

a base frame for supporting the image forming unit;

an optical unit frame located above the base frame for supporting the optical unit, the optical unit frame having an extension portion positioned above the discharge tray; and a reinforcing member attached to the optical unit frame, the reinforcing member including an attachment portion extending in a horizontal direction for reinforcing the extension portion of the optical unit frame and a restricting portion extending in a downward depending direction;

said restricting portion being spaced from said base frame portion on said base frame in the absence of application of an excessive load to the optical unit frame;

said restricting portion being in contact with said base frame portion upon application of an excessive load to said optical unit frame.

5. An image forming apparatus comprising:

an optical unit for guiding a light image from a document;

an image forming unit for forming a toner image in accordance with the light image;

a transfer unit for transferring the toner image on copy paper;

a discharge tray for receiving copy paper transferred with the toner image;

a base frame for supporting the image forming unit;

an optical unit frame located above the base frame for supporting the optical unit, the optical unit frame having an extension portion positioned above the discharge tray; and a reinforcing member attached to the optical unit frame, the reinforcing member including:

an attachment portion extending in a horizontal direction for reinforcing the extension portion of the optical unit frame; and a restricting portion extending in a vertical direction and having a lower end operable to come into contact with a specified portion of the base frame when the optical unit frame is subjected to an excessive load, the restricting portion having a contact portion in a lower end thereof, the contact portion having the form of a plate.

* * * * *